United States Patent [19]

Johnson

[11] 3,969,595

[45] July 13, 1976

[54] SEQUENTIAL SWITCHING ASSEMBLY HAVING PLURAL, SPACED FLEXIBLE CONTACT LAYERS

[75] Inventor: Wendell C. Johnson, Topanga, Calif.

[73] Assignee: Xerox Corporation, Stamford, Conn.

[22] Filed: Sept. 23, 1974

[21] Appl. No.: 508,477

[52] U.S. Cl. ..... 200/5 A; 200/86 R; 200/159 B; 200/275

[51] Int. Cl.[2] ..... H01H 13/70; H01H 1/06

[58] Field of Search ..... 200/5 R, 5 A, 159 B, 200/275, 86 R, 83; 197/98, 113, 181

[56] References Cited

UNITED STATES PATENTS

| | | | |
|---|---|---|---|
| 3,544,746 | 12/1970 | Wolf et al. | 200/86 R |
| 3,600,528 | 8/1971 | Leposavic | 200/5 A |
| 3,617,666 | 11/1971 | Braue | 200/86 R |
| 3,643,041 | 2/1972 | Jackson | 200/159 B X |
| 3,742,157 | 6/1973 | Leposavic | 200/5 A |
| 3,829,632 | 8/1974 | Klehm, Jr. | 200/159 B X |
| 3,917,917 | 11/1975 | Murata | 200/5 R X |
| 3,928,736 | 12/1975 | Drage | 200/5 A |

*Primary Examiner*—James R. Scott
*Attorney, Agent, or Firm*—John E. Beck; Terry J. Anderson; Leonard Zalman

[57] ABSTRACT

A multiple switching apparatus comprising two spring-like switching members disposed in a tandem array with each integral with its metallic support base. The central area of each of the switching members is defined by a plurality of slots formed in the support base with the length and displacement of the slots defining the force-displacement characteristics of each switching member and, accordingly, of the tandem array. The top switching member moves downward until it produces a first switching function, with further movement of the top switching member effecting movement of the second switching member such that a second switching function is produced.

6 Claims, 15 Drawing Figures

SEQUENTIAL SWITCHING ASSEMBLY HAVING PLURAL, SPACED FLEXIBLE CONTACT LAYERS

BACKGROUND OF THE INVENTION

There are many applications relating to typewriters and other data entry devices for which a multiple switching action is desirable. For example, in U.S. Pat. No. 3,780,846, there is desired a multiple switching arrangement which utilizes a key lever having two contact points, first and second spring members, and primary and secondary key switches which are physically displaced along the longitudinal axis of the key lever. Initial motion of the key lever is effective to close the primary key switch and further depression of the key lever is effective to close the secondary key switch.

The use of two discrete springs and two discrete switches makes the multiple switching arrangement described expensive to produce. Also, the longitudinal displacement of the key switches makes the keyboard unduly large. Additionally, the multiple switching arrangement described does not provide a satisfactory mechanical sensory feedback signal through the operators fingertips to give the operator an indication that one or both the switching functons has been achieved.

OBJECTS OF THE INVENTION

It is an object of the present invention to provide an improved switching apparatus having multiple switching capabilities.

It is a further object of the present invention to provide a switching apparatus having multiple switching capabilities that has a minimum of parts.

It is a further object of the present invention to provide a switching apparatus having multiple switching capabilities that requires a minimum of space.

It is a still further object of the present invention to provide a keyboard in which one or more of the keys can produce a multiple switching action.

SUMMARY OF THE INVENTION

In accordance with the invention, the aforementioned objects are achieved by providing two forceably moveable switching members in axial alignment with each member having a built-in spring action which returns it to its initial position after the force is removed. Each of the switching members is characterized by a plurality of slots formed in a continuous, metallic support base. The slot arrangement provides a flexible, unitary switch which allows the top switching member, and especially a central area thereof, to travel toward, and even past, the plane of the metallic support base defining the lower switching member.

The multiple switch closures can produce a multiple capacitive switching action, or a multiple mechanical switching action, or a combination of capacitive switching and mechanical switching. Further, where capacitive switching is used, the capacitive coupling is greater than that of prior art capacitive switches since a moveable plate of the capacitive switch can easily be connected to a voltage source, via a connection through the metallic support base. Also, since both plates of the capacitive switch can move once a predetermined separation therebetween is achieved, the capacitive coupling remains constant even with further movement of both of the plates, and a very positive switching action is achieved.

The foregoing objects and other objects and advantages of the present invention will become apparent from the reading of the following specification in conjunction with the accompanying drawings in which.

DESCRIPTION OF THE PREFERRED EMBODIMENT

Figure 1:
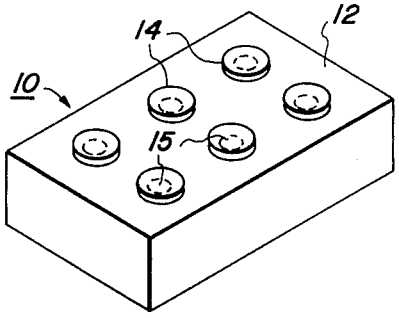
FIG. 1 is a prospective view of a data entry device incorporating a keyboard having switches in accordance with the present invention.

Referring to FIG. 1, there is presented a data entry device 10, such as a typewriter, calculator, or computer terminal, in which the present invention can be incorporated. The illustrated device includes a keyboard panel 12 having a plurality of keys 14 arranged in a conventional manner to be depressed by the fingertips of an operator, thus entering the required data into the data entry device. Each key has a post 15 (shown in phantom) that would be in contact with or be disposed adjacent to the upper moveable switching member of each tandem array of switching members to be described.

Figure 2A:
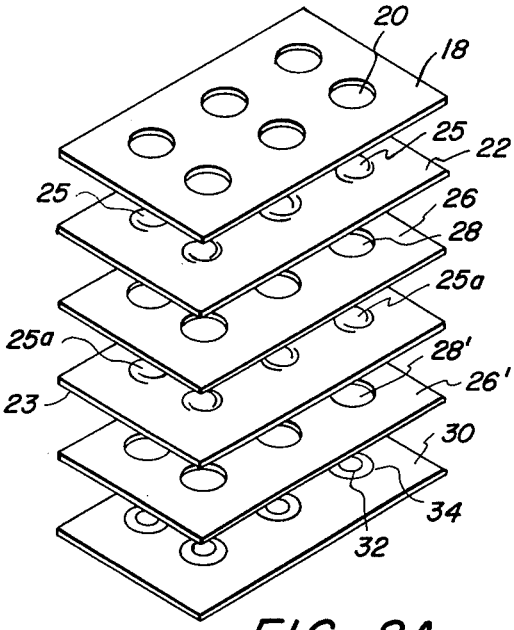
FIGS. 2A and 2B are exploded views of two types of keyboards incorporating the present invention.

Referring now to FIG. 2A, the keyboard 12 of FIG. 1 is shown in greater detail and in an exploded form. The keyboard includes an insulating plate 18 having a plurality of openings 20 therein. Mounted below plate 18 is a first, thin, continuous sheet of metal 22 which has a plurality of moveable switching members 25 formed therein. The structure of the moveable switching elements 25 is described in detail hereinafter. Immediately below sheet 22, and preferably in contact therewith, is a flat insulating plate 26 of any conventional insulating material, such as Mylar, which has a plurality of holes 28 therein. Positioned beneath the insulating plate 26, and preferably in contact therewith, is a second, thin, continuous sheet of metal 23 which also has a plurality of moveable switching members **25*a* formed therein. In a preferred embodiment of the invention, switching members 25*a* are identical to switching members 25. Immediately below the sheet 23, and preferably in contact therewith, is a second flat insulating plate 26' which may be identical in form and composition with plate 26 and which has a plurality of holes 28' therein. Below plate 26' is a conventional printed circuit board 30 having metallic contact buttons or rings 32 formed, as by etching, on its insulating substrate 34.**

As shown in FIG. 2A, each of the openings 20, each of the holes 28 and 28′ and each of the contact buttons 32 is in registration with a different, axially aligned pair of the moveable switching members 25 and 25*a* of the sheets 22 and 23, respectively. As clearly shown, in FIG. 2A, and even more explicitly in FIG. 4, the axial alignment of each pair of switching members 25 and 25*a* is along a line perpendicular to each of the plates 22 and 23. The plate 18, the metallic sheets 22 and 23, the insulating plates 26 and 26′ and the circuit board 30 preferably would form a sandwich-like structure which is extremely compact and occupies only a thin top layer of the device 10.

Figure 3C:
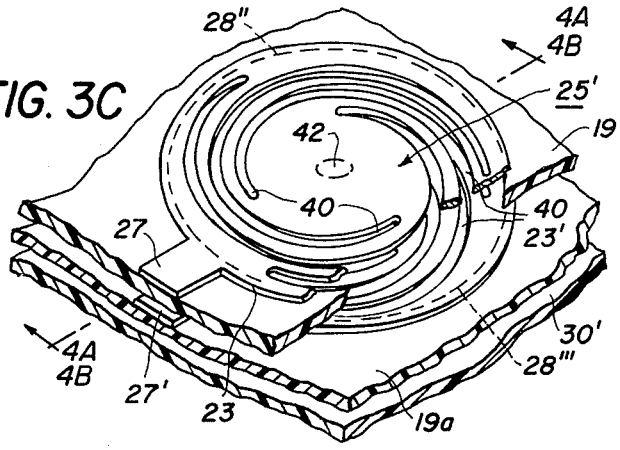
FIG. 3C is a perspective view of one tandem pair of switching members of the apparatus of FIG. 2B.
Figure 2B:
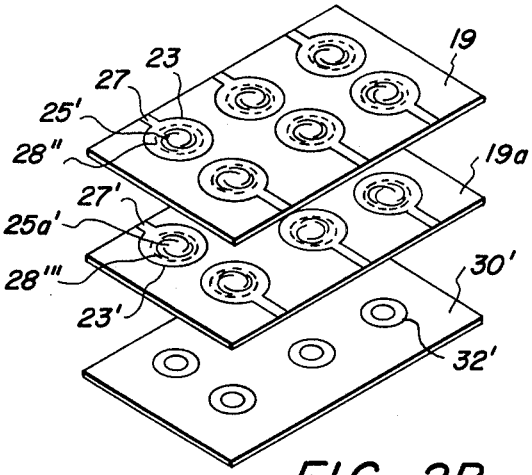

The sheet 22 and the plate 26, and, likewise, the sheet 23 and the plate 26′, may be an integral structure, such as a printed circuit board, with the insulating plate having the top surface metalized with a thin, e.g. 0.001 inch thick, coating of metal of, for example, a Beryllium copper alloy. In such a case, as illustrated in FIG. 2B, the metallic coating on the printed circuit board 19 would be etched to provide a plurality of co-planar metalized areas 23 each of which has a moveable switching member 25′ formed therein. Similarly, the metallic coating on the printed circuit board 19*a* would be etched to provide a plurality of co-planar metalized areas 23′ each of which has a moveable switching member 25*a*′ formed therein. The metallic coatings would be further etched to provide integral leads 27 and 27′ which would be connected to supply means (not shown) for maintaining each of the switching members 25′ and 25*a*′ at a desire potential. The circuit boards 19 and 19*a* have therein holes 28″ and 28‴, respectively, below each of the switching members 25′ and 25*a*′, respectively, for allowing downward movement of switching members 25′ and 25*a*′ toward the contact areas 32′ of a circuit board 30′. FIG. 3C shows in perspective a tandem pair of switches of the type of FIG. 2B.

Figure 3A:
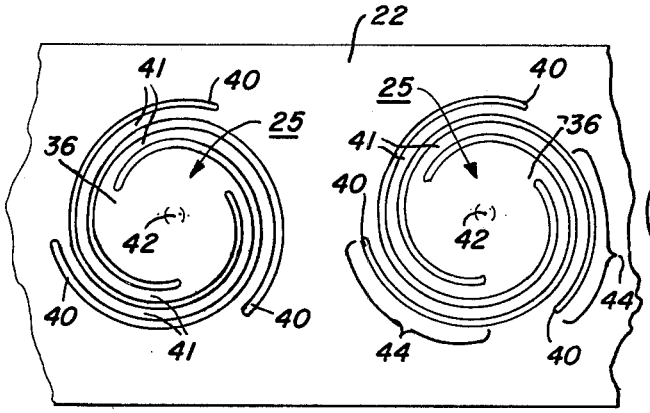
Fig. 3A is a plan view of a portion of the keyboard of FIG. 2A.
Figure 3B:
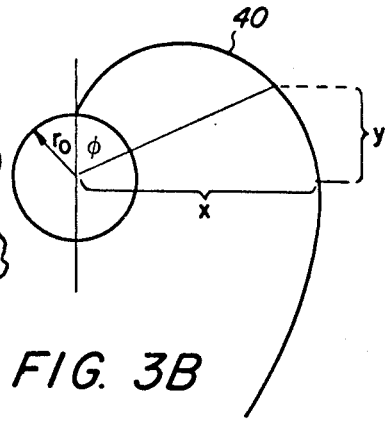
FIG. 3B is a graph exemplifying the shape of the slots of the portion of the keyboard shown in FIG. 3A.

A plain view of a portion of sheet 22 is shown in FIG. 3A. Each moveable switching member 25 includes a central contact area 36 which is surrounded by a group of unconnected, curved slots 40. The slots 40 extend radially outward, preferably at a steadily increasing rate, from the central areas 36. The slots 40 of each switching member may be in the form of a spiral and preferably originate from points that are equally spaced around the periphery of the central switch area 36 an equal distant from a central portion 42 of the central area 36. If the moveable switching members 25 are to be formed as contact switches, each of the central portions 42 may be in the form of a dimple extending downwardly toward the circuit board 30. Preferably, the slots 40 are involutes of a circle repeated three times at 120°intervals around the central area 36. The involutes would have X and Y dimensions according to the formulas $X = r_o (\sin \phi - \phi \cos \phi)$ and $Y = r_o (\cos \phi + \phi \sin \phi)$, where $r_o$ is the distance from the central portion 42 to the beginning of each spiral and the angle $\phi$ is measured from the point where each of the spirals begins, as shown in FIG. 3B.

As shown in FIG. 3A, adjacent slots 40 are equally spaced from each other where they are adjacent and define support legs 41 between adjacent portions. Also as shown in FIG 3A, each switching member 25 is defined by three slots 40, with each of the slots preferably ½ millimeter wide and each preferably extending for about 325 rotary degrees from start to finish, which provides a structure wherein the three slots 40 defining each switching member have portions adjacent each other and equally spaced from each other over areas 44 which are equally spaced around central area 36. If desired, the inner terminus of each slot 40 can be extended inwardly or outwardly, that is, $r_o$ can be decreased or increased, or the outer terminus of each slot 40 may be extended outwardly or inwardly to provide a difference spring force for the switching members 25, that is, more or less force to move a switching member 25 a predetermined displacement distance. If desired, different switching members 25 may have a different spring force. As noted, switching members 25*a* may be, and preferably are, identical to switching members 25. All modifications relating to the slots defining switching members 25 are also applicable to switching members 25*a*.

In the illustrated embodiment of FIG. 2A, sheets 22 and 23 can be of beryllium copper having a thickness of ¼ millimeter. As noted, the slots 40 preferably would be ½ millimeter wide and may be formed by conventional printed circuit techniques such as, for example, chemical milling. Preferably, the inner terminus of each of the slots 40 would be four millimeters from the central portion 42 of the central areas 36, although a greater distance will produce a moveable member that is more rigid (less springy) than the preferred form, and a lesser distance will produce a moveable member that is less rigid (more springy) than the preferred form. The distance between central portions 42 is preferably threequarters of an inch. Specified dimensions of only exemplary and can be changed to achieve desired spring forces.

Figure 4:
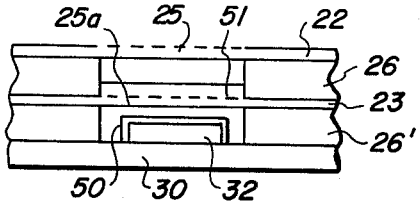
FIG. 4 is a cross-sectional view of one pair of switching members of the apparatus of FIG. 2A.
Figure 4A:
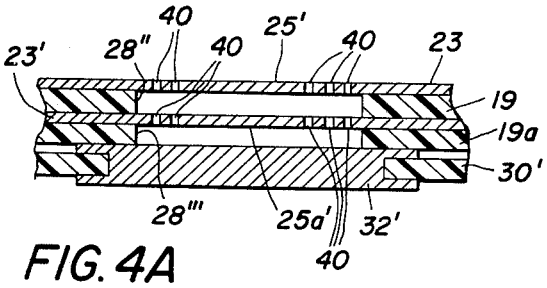
FIGS. 4A and 4B are cross-sectional views of one pair of switching members of the apparatus of FIG. 3C in respective open and closed positions.
Figure 4B:
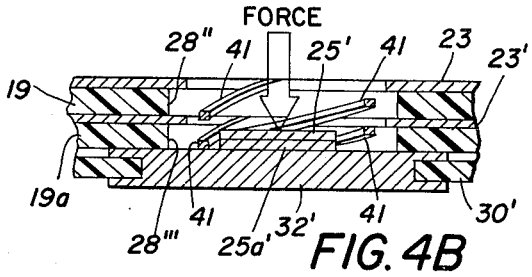
Figure 5A:
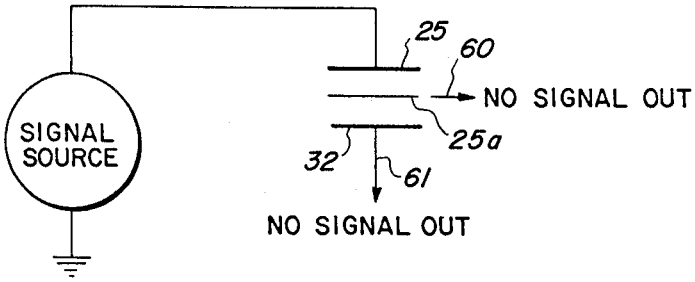
FIG. 5A, 5B and 5C show the output signals generated by the apparauts of FIG. 4.
Figure 5B:
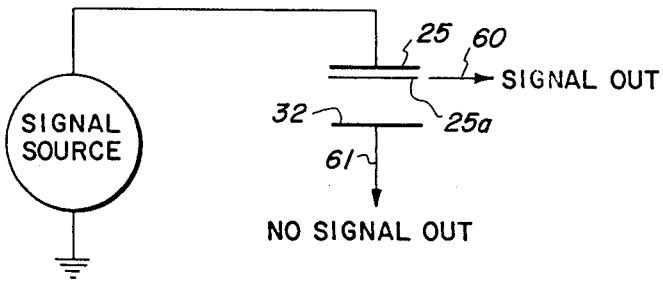
Figure 5C:
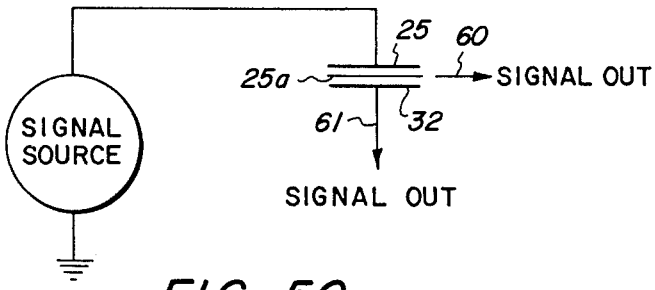

Referring now to FIG. 4 there is shown a cross sectional view taken of one set of axially aligned switching members 25 and 25*a* of the apparatus of FIG. 2A. When used for capacitive switching, thin insulator layers 50 and 51 preferably cover contact 32 and moveable switching member 25*a*, respectively, to present shorting when the switching members are forced downward. With the structure shown in FIG. 4, two switching actions can be achieved, as illustrated in FIg. 5 which shows the electrical analog of the device of FIG. 4, that is, two capacitors in series. Electrical leads supply a signal to switching member 25 and convey output signals from switching member 25*a* and contact 32. In the position when neither switching member 25 nor 25*a* is depressed, the leads 60 and 62 have no output, that is, the capacitive coupling between them is small and they act as open switches, as shown in FIG. 5A. When the moveable member 25 is depressed, as by the downward movement of post 15, the capacitive coupling between members 25 and 25*a* increases such that conventional sensing circuitry will sense the change in capacitance and indicate an output signal on lead 60, but still no output signal on lead 62, as depicted in FIG. 9B. When moveable switching member 25 is depressed further, it contacts layer 51 and further downward movement of member 25 now also moves layer 51 and member 25*a* downward. With downward movement of member 25*a*, the capacitive coupling between member 25*a* and contact 32 increases to generate, after sufficient downward movement of member 25*a*, a second output signal on line 62, as shown in FIG. 5*c*. Once switching member 25 hits the insulating layer 51 above member 25*a*, moveable members 25 and 25*a* move as a pair, retaining the spacing therebetween. Thus, the output signal on lead 60 does not change in amplitude once member 25*a* begins to move downward. Obviously, for contact switching insulating layers 50 and 51 would not be used as shown in FIGS. 4A and 4B which show cross-sectional views of a tandem pair of contact switches of the type of FIG. 3C in respective open and totally closed positions.

Figure 6:
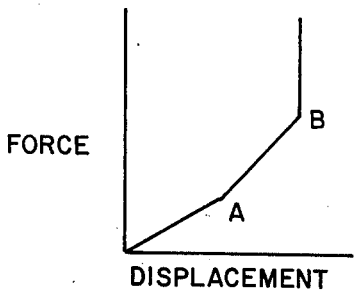
FIG. 6 shows the force-displacement characteristics of the apparatus of FIG. 4.

FIG. 6 shows the force-displacement curve of the switching device of FIG. 4. As shown, the forced displacement curve increases linearly at a first rate until the switching member 25 hits the layer 51 (point A), at which time the force-displacement curve increases at a second, steeper rate, due to the combined resistance of members 25 and 25*a* which act as springs in parallel, until the members 25*a* contacts layer 50. After the latter contact (point B), additional force will not produce additional displacement. As clearly indicated by FIG. 6, the tandem switching arrangement of the present invention provides satisfactory sensory feedback signals (points A & B) through the fingertips of the operator to indicate that one or both desired switching functions has been received. If only one switching function is desired, displacement of switching member 25 would cease at about point A.

Figure 7:
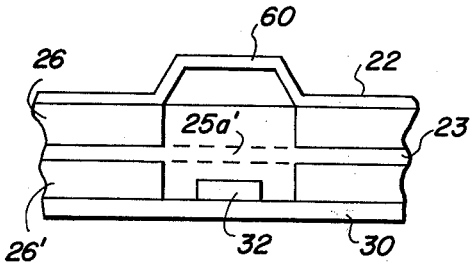
FIG. 7 is a cross-sectional view of another form of multiple switching apparatus.
Figure 8:
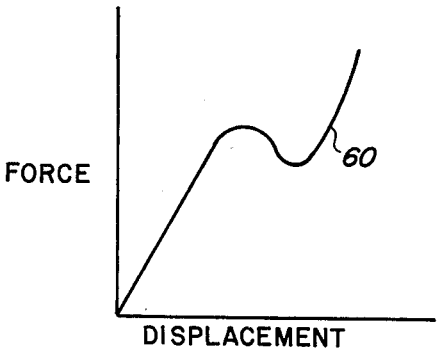
FIG. 8 shows the force-displacement chararacteristics of the apparatus of FIG. 7.

Multiple switching can be achieved also by using one of he spring contacts taught by U. S. pat. application, Ser. No. 508,482 filed Sept. 23, 1974; wherein the metallic strips between adjacent slots 40 have been stretched beyond their elastic limit such that the central area 36 is raised above plate 22, by integral support legs, as shown by switching member 60 in FIG. 7. The plastic deformation required to produce the support legs can be achieved in a conventional forming die as described in the aforementioned patent application. The first moveable contact member 60 is depressed until it hits the moveable contact member 25*a* therebeneath at which time both contacts would move until fixed contact 32 is reached. Thus, an output signal is generated from member 25*a* when central contact area 36 of member 60 contacts it and a second output is generated when the central area of member 25*a* contacts contact 32. As illustrated in FIG. 8, in which the portion up to displacement "60" illustrates the force-displacement characteristics of member 60, the deformed switching member 60 has a positive force-displacement characteristic until the central area 36 passes below the plane of sheet 22 and then has a negative force-displacement characteristic for a short, additional displacement before once again assuming a positive force-displacement characteristic. The change from a positive force-displacement characteristic to a negative force-displacement characteristic produces a sensory feedback signal through the fingertips of the key or switch operator, which indicates to the operator that the key has been depressed a sufficient distance to achieve a desired switching action either capacitive or mechanical. In FIG. 7, a thin insulating layer would cover members 25*a* and 32 to achieve capacitive switching. Also, both of the switching members of FIG. 7 could be of the deformed type.

The thickness of the support legs, the temper of the metal of the support legs, and the degree that they are stretched, that is, the distance from the plane of sheet 22 to the plane of the central area 36 of member 60, which preferably is about 3 mm, determines the force-displacement characteristics of switching member 60. By adjusting the force-displacement of each of the switching members 60 and 25*a*, a wide variety of total force-displacement characteristics can be produced which are desirable to the switch or key operator. To achieve a modified force-displacement characteristic of the tandem switching members, whether planar or deformed or some combination thereof, either the upper or lower switching member or both switching members may be provided with a downward bias or preload force, for example, ten grams or preload force.

I claim:

1. A switching device comprising:

a first metallic contact member having a first focibly movable contact area portion defined therein by a plurality of curved slots and a support portion surrounding said first forcibly movable contact area portion, a second metallic contact member having a second forcibly movable contact area portion defined therein by a plurality of curved slots and a support portion surrounding said second forcibly movable contact area portion, a third metallic contact member, first means for combining said metallic contact members into a unitary structure with said first and second metallic contact members adjacent each other and electrically isolated from each other, with said second and third metallic contact members adjacent each other and electrically isolated from each other, and with said first and second movable contact area portions in axial alignment with at least a portion of said third contact member, said first means permitting movement of said first and second contact area portions along said alignment axis, second means for maintaining adjacent contact members at different potentials, and switch actuating means in operative association with said contact members, said switch actuating means being capable of achieving (1) movement when a force is applied thereto of only said first contact area portion of said first metallic member without movement of said support portion surrounding said first forcible movable contact area portion and without changing the shape of said first contact area portion to achieve one switching function or (2) movement of both said first contact area portion of said first metallic member without movement of said support portion surrounding said first forcibly movable contact area portion and without changing the shape of said first contact area portion and said second contact area portion of said second metallic contact member without movement of said support portion surrounding said second forcibly movable contact area portion and without changing the shape of said second contact area portion to achieve two switching functions, with said first contact area portion being capable of movement independent of movement of said second contact area portion and with said second contact area portion being capable of movement only in conjunction with movement of said first contact area portion.

2. The apparatus of claim 1 wherein at least one of said contact area portions is normally in a different plane than is associated support portion.

3. A switching device capable of producing consecutive switching functions comprising:

a first metallic contact member having a first forcibly movable contact area portion defined therein by a plurality of curved slots and a support portion surrounding said first forcibly movable contact area portion, a second metallic contact member having a second forcibly movable contact area portion defined therein by a plurality of curved slots and a support portion surrounding said forcibly movable contact area portion, at least one of said contact area portions being normally in a different plane than its associated support portion, a third metallic contact member, first means for combining said metallic contact members into a unitary structure with said first and second contact members adjacent each other and electrically isolated from each other and with said second and third contact members adjacent each other and electrically isolated from each other, and with said first and second contact area portions in axial alignment with at least a portion of said third metallic contact member, said means permitting movement of said first and second contact area portions along said alignment axis, second means for maintaining adjacent contact members at different potentials, and force conveying means for first effecting movement along said alignment axis of only said first contact area portion without movement of said support portion surrounding said first contact area portion and without changing the shape of said first contact area portion to achieve a first switching action and, after sufficient movement of said first contact area portion, for effecting movement of both said first and second contact area portions along said alignment axis without movement of said support portion surrounding said first contact area portion and without movement of said support portion surrounding said second contact area portion and without changing the shape of either said first or second contact area portions to achieve a second switching action.

4. A keyboard switching apparatus for effecting one or more switching functions when an actuating means is depressed comprising:

a plurality of switching members each capable of producing multiple switching functions, each said switching members being comprised of a first forcibly movable metallic contact area portion defined by a plurality of curved slots and a support portion surrounding said first forcibly movable contact area portion, a second forcibly movable metallic contact area portion defined by a plurality of curved slots and a support portion surrounding said second forcibly movable contact area portion, and a third metallic contact area portion, first means for combining said switching members into a unitary structure with said first and second contact area portions of each switching member adjacent each other and electrically isolated from each other, with said second and third contact area portions of each switching member adjacent each other and electrically isolated from each other, and with said movable contact area portions of each switching member in axial alignment with at least a portion of said third contact area portion, said first means permitting movement of said first and second contact area portions of each contact member along the alignment axis of that switching member without movement of the support portions surrounding said first and second contact area portions and without changing the shape of said first and second contact area portions, second means for maintaining adjacent contact area portions of each switching member at different potentials, and a plurality of switch actuating means, each of said switch actuating means being in operative association with a different one of said switching members with each actuating means being capable of achieving movement when a force is applied thereto of only said first contact area portion associated therewith to achieve one switching function or movement of both said first and second contact area portions associated therewith to achieve two switching functions, with said first contact area portion of each switching member being capable of movement independent of movement of said second contact area portion of that switching member and with said second contact area portion of each switching member being capable of movement only in conjunction with movement of said first contact area portion of that switching member.

5. A keyboard switching apparatus for effecting one or more switching functions when an actuating means is depressed comprising:

a plurality of switching members each capable of producing multiple switching functions, each of said switching members being comprised of a first forcibly movable metallic contact area portion defined by a plurality of curved slots and a support portion surrounding the first contact area portion, a second forcibly movable metallic contact area portion defined by a plurality of curved slots and a support portion surrounding said second contact area portion, and a third metallic contact area portion, first means for combining said switching members into a unitary structure with said first and second contact area portions of each switching member adjacent each other and electrically isolated from each other, with said second and third contact area portions adjacent each other and electrically isolated from each other, and with said movable contact area portions of each switching member in axial alignment with at least a portion of said third contact area portion, said first means permitting movement of said first and second contact area portions of each contact member along the alignment axis of that switching member, second means for maintaining adjacent contact area portions of each switching member at different potentials, and a plurality of force conveying means, each of said force conveying means being in operative association with a different one of said switching members for first effecting movement along the alignment axis of its associated switching member of only said first contact area portion of that switching member without changing the shape of said first contact area to achieve a first switching action and, after sufficient movement of said first contact area portion, for effecting movement of both said first and second contact area portions along said alignment axis of said associated switching member without changing the shape of either said first or second contact area portions to achieve a second switching action.

6. The apparatus of claim 5 wherein at least some of said contact area portions are normally in a different plane than their respective associated support portions.

* * * * *